US011371254B2

(12) United States Patent
van der Meijden et al.

(10) Patent No.: US 11,371,254 B2
(45) Date of Patent: Jun. 28, 2022

(54) BUOYANT AUTOMATIC CLEANERS FOR SPAS AND OTHER WATER-CONTAINING VESSELS

(71) Applicant: ZODIAC POOL SYSTEMS LLC, Carlsbad, CA (US)

(72) Inventors: Hendrikus Johannes van der Meijden, Midrand (ZA); Phillip Newman, Howick (ZA)

(73) Assignee: ZODIAC POOL SYSTEMS LLC, Carlsbad, CA (US)

( * ) Notice: Subject to any disclaimer, the term of this patent is extended or adjusted under 35 U.S.C. 154(b) by 0 days.

(21) Appl. No.: 16/822,562

(22) Filed: Mar. 18, 2020

(65) Prior Publication Data

US 2020/0256076 A1 Aug. 13, 2020

Related U.S. Application Data

(62) Division of application No. 15/695,519, filed on Sep. 5, 2017, now Pat. No. 10,968,651.

(60) Provisional application No. 62/383,777, filed on Sep. 6, 2016.

(51) Int. Cl.
*E04H 4/16* (2006.01)

(52) U.S. Cl.
CPC ..... *E04H 4/1654* (2013.01); *E04H 4/1663* (2013.01)

(58) Field of Classification Search
CPC ..... E04H 4/1654; E04H 4/1663; E04H 4/16
USPC ..... 210/167.16, 167.17, 143; 15/1.7
See application file for complete search history.

(56) References Cited

U.S. PATENT DOCUMENTS

| | | | |
|---|---|---|---|
| 3,422,478 | A | 1/1969 | Osborne |
| 4,154,680 | A | 5/1979 | Sommer |
| 5,985,156 | A | 11/1999 | Henkin et al. |
| 6,365,039 | B1 | 4/2002 | Henkin et al. |
| 8,510,889 | B2 | 8/2013 | Hui et al. |
| 8,771,504 | B2 | 7/2014 | Mastio et al. |
| 9,212,498 | B2 | 12/2015 | Pichon et al. |
| 9,527,537 | B2 * | 12/2016 | Bernini ..... E04H 4/1654 |

(Continued)

FOREIGN PATENT DOCUMENTS

| | | |
|---|---|---|
| EP | 1980687 | 10/2008 |
| WO | 9749504 | 12/1997 |

(Continued)

OTHER PUBLICATIONS

Wireless Pool Pressure/Temperature Sensor, Phoenix Sensors, Data Sheet WPT202, Available online at https://phoenixsensors.com/products/wireless-pressure-sensors/pool-wireless-pressure-sensor/, May 2014, 4 pages.

(Continued)

*Primary Examiner* — Monica S Carter
*Assistant Examiner* — Abbie E Quann
(74) *Attorney, Agent, or Firm* — Kilpatrick Townsend & Stockton LLP

(57) ABSTRACT

Autonomous, mobile cleaners for water-containing vessels such as swimming pools and spas are detailed. The cleaners are especially useful for cleaning spas, although they may function adequately in connection with certain other vessels as well. They may be designed and constructed in particular to avoid high centering so as not to become stuck when encountering obstacles within the spas or other vessels.

6 Claims, 11 Drawing Sheets

(56) References Cited

U.S. PATENT DOCUMENTS

| | | | | |
|---|---|---|---|---|
| 10,968,651 | B2 | 4/2021 | Van der Meijden et al. | |
| 2002/0084218 | A1 | 7/2002 | Illingworth | |
| 2009/0089944 | A1* | 4/2009 | Griffin | F16K 11/20 15/1.7 |
| 2009/0307854 | A1 | 12/2009 | Garti | |
| 2011/0047727 | A1 | 3/2011 | Pichon et al. | |
| 2014/0184065 | A1 | 7/2014 | Deery et al. | |
| 2014/0259466 | A1 | 9/2014 | Renaud et al. | |
| 2015/0375812 | A1 | 12/2015 | Bernini | |
| 2016/0145884 | A1* | 5/2016 | Erlich | E04H 4/1636 15/1.7 |
| 2016/0244988 | A1* | 8/2016 | Barcelos | G05D 1/0242 |
| 2016/0333600 | A1* | 11/2016 | van der Meijden | E04H 4/1663 |
| 2017/0248568 | A1 | 8/2017 | Yizhack et al. | |

FOREIGN PATENT DOCUMENTS

| | | | | |
|---|---|---|---|---|
| WO | WO-9749504 | A1 * | 12/1997 | E04H 4/1654 |
| WO | 0136335 | | 5/2001 | |
| WO | 2006014746 | | 2/2006 | |

OTHER PUBLICATIONS

U.S. Appl. No. 15/695,519, Final Office Action dated Oct. 2, 2019, 14 pages.
U.S. Appl. No. 15/695,519, Non-Final Office Action dated Apr. 18, 2019, 14 pages.
International Application No. PCT/US2017/050077, International Preliminary Report on Patentability dated Mar. 21, 2019, 11 pages.
International Application No. PCT/US2017/050077, International Search Report and Written Opinion dated Mar. 19, 2018, 16 pages.
International Application No. PCT/US2017/050077, Invitation to Pay Add'l Fees and Partial Search Report dated Jan. 8, 2018, 6 pages.
European Application No. 17768327.3, Office Action dated May 12, 2020, 5 pages.
U.S. Appl. No. 15/695,519, Non-Final Office Action dated Jun. 19, 2020, 11 pages.
U.S. Appl. No. 15/695,519, Notice of Allowance dated Feb. 16, 2021, 8 pages.
European Application No. 17768327.3, Office Action dated Apr. 28, 2021, 6 pages.
U.S. Appl. No. 17/189,948, Non-Final Office Action dated Nov. 19, 2021, 7 pages.
U.S. Appl. No. 17/190,020, Non-Final Office Action dated Nov. 23, 2021, 11 pages.
U.S. Appl. No. 17/190,079, Non-Final Office Action dated Nov. 24, 2021, 11 pages.
U.S. Appl. No. 17/190,079, Final Office Action dated Feb. 15, 2022, 11 pages.
U.S. Appl. No. 17/189,948, Final Office Action dated Mar. 18, 2022, 8 pages.
U.S. Appl. No. 17/190,020, Final Office Action dated Mar. 21, 2022, 12 pages.

* cited by examiner

BUOYANT AUTOMATIC CLEANERS FOR SPAS AND OTHER WATER-CONTAINING VESSELS

CROSS-REFERENCE TO RELATED APPLICATION

This application is a division of pending U.S. patent application Ser. No. 15/695,519, filed Sep. 5, 2017, and having the same title as appears above, which claims the benefit of and priority to U.S. Provisional Patent Application Ser. No. 62/383,777, filed Sep. 6, 2016, and having the same title as appears above, the entire contents of both of which applications are hereby incorporated herein by this reference.

FIELD OF THE INVENTION

This invention relates to autonomous, mobile cleaners for water-containing vessels such as swimming pools and spas and more particularly, although not necessarily exclusively, to buoyant cleaners of vessels having complex interior geometries such as spas.

BACKGROUND OF THE INVENTION

Numerous automatic pool cleaners exist. Typically these cleaners travel along bottom surfaces (floors) of pools, vacuuming debris-laden water through filters which capture the debris. Some cleaners also are configured to climb side surfaces (walls) of pools in an effort to capture particulate matter either attached to the walls or suspended in pool water adjacent the walls. Because intended to clean floors of pools and remain partly or wholly submerged in water while in use, these cleaners are designed and weighted so as not to be buoyant in water. This is especially true for electrically-powered pool cleaners, whose on-board motors, pumps, and (in some cases) batteries have substantial weight. Such cleaners are difficult to retrieve from pool floors when their batteries discharge, however, and may require additional mechanical or electrical mechanisms for maneuvering when their movement is impeded by, for example, complex geometries within pools.

U.S. Pat. No. 4,154,680 to Sommer, whose entire contents are incorporated herein by this reference, describes one such electrically-powered pool cleaner. In an effort to make it easier to retrieve from a pool, the cleaner includes "diving cells" mounted to its chassis for purposes of raising and lowering the chassis in the pool. Attached to the diving cells is an elongated air hose extending upward "beyond the water surface." See Sommer, col. 2, ll. 40-47. A bidirectional on-board pump is used to flood the diving cells with water to ensure the cleaner submerges in the pool water for cleaning purposes. Changing rotational direction "causes the diving cells to fill with air and the [cleaner] to rise to the surface" of the pool for retrieval. See id., col. 3, ll. 28-39 (numeral omitted).

Absent from existing automatic cleaners is any natural buoyancy of their bodies or chassis. If a cleaner were made with positive buoyancy, no diving cells and elongated air hose would be needed to raise the cleaner to the water surface. Instead, the cleaner would naturally float to the surface—unless and until subjected to sufficient down force to counteract the buoyancy.

European Patent Application No. 1980687 of Hui, whose entire contents are incorporated herein by this reference, details another electrically-powered pool cleaner with negative buoyancy. Also consistent with conventional designs, the bottom surface of the cleaner of the Hui application is flat, forming a plane parallel to the pool surface to be cleaned. See Hui, col. 4, ll. 41-44. The planar bottom surface, moreover, is positioned "close to [the] swimming pool floor" so as to improve water intake into the cleaner. This combination of planar bottom surface both parallel, and closely positioned, to the to-be-cleaned surface subjects the cleaner of the Hui application to risk of becoming stuck (e.g. high-centering) when the cleaner encounters obstacles protruding upward from the surface. This risk of high-centering is further increased by the fact that water is output from the cleaner in a direction perpendicular to the surface to be cleaned, hence providing no forward motive force.

SUMMARY OF THE INVENTION

The present invention seeks to resolve these and other issues associated with conventional automatic cleaners. It also attempts to provide automatic cleaners well adapted to clean spas and other generally smaller water-containing vessels having complex interior geometries. Autonomous cleaning devices consistent with the present invention thus include numerous features not present in existing automatic pool cleaners.

As one such example, the present innovative cleaners may have positive buoyancy. Accordingly, they are capable of naturally floating to the water surface when not subjected to countervailing forces. Versions of the cleaner may include a motor and possibly an associated pump as well as a battery for powering the motor. These versions also could include a turbine, propeller, or other means for creating down force when the motor is operating.

In use, therefore, operation of the motor would create down force counteracting the positive buoyancy of the cleaner. This would cause the cleaner to remain submerged within a vessel so as to perform its cleaning functions in conventional ways. However, when the battery discharges, operation of the motor will cease, and the cleaner will float to the vessel surface for retrieval. Similarly, if the cleaner is programmed or configured to withdraw power to the motor at a particular time (e.g. end of a cleaning cycle) or upon occurrence of a particular event (e.g. movement of the submerged cleaner is impeded), the cleaner again will float to the surface.

Moreover, some versions of the cleaner may disconnect the motor from the power source either at designated intervals or randomly and subsequently reconnect the two. In this manner, the cleaner will, from time to time, float to (or toward) the vessel surface and, in effect, reposition itself within the vessel before submerging or lowering again when the motor recommences operation. Hence, the repositioning may allow for elevational changes by the cleaner (useful for "climbing" steps or benches), moving up over floor obstacles, changing directions of movement, or simple movement so as to increase cleaning coverage. The process often avoids the cleaner becoming stuck in particular regions of a vessel or, if a cleaner has become stuck, provides opportunities to release the cleaner from the obstacle. It thus makes the cleaner especially useful for operating in spas, which often have complex interior geometries with, for example, sharp angles, benches, steps, jet nozzles, air nozzles, water outlets, drains, foot massage features, etc.

Accordingly, positive-buoyancy cleaners of the present invention permit cleaning of vessels such as swimming pools and spas while facilitating retrieval of the cleaners and reducing risk of their travel being impeded for long periods of time. Because no elongated air hose, electrical cord, or cable is needed by any of the inventive cleaners, no risk of tangling or sticking of such hose, cord, or cable exists. Similarly, because no back-up valve, pressurized back-up jet, or other mechanical or electrical mechanism is needed to effect repositioning (or change of movement direction) of the cleaners, they may be simpler, and less prone to component failure, than conventional devices.

Furthermore, at least some versions of the present automatic cleaners contemplate using at least one propeller to generate down force. The propeller may provide torque, rotating the cleaner as it descends to the floor of a vessel. This usually will cause the cleaner to face in a different direction than it did when it ascended, further reducing the possibility of the cleaner remaining in, or immediately returning to, the same floor location for cleaning. Yet other versions may angle the propeller output away from the vertical, providing lateral movement so as to "push" the cleaners away from positions in which they might stick. Alternatively or additionally, buoyancy of the cleaners may be asymmetric (e.g. one side may be made more buoyant in water than another side) for purposes of displacing the cleaners laterally if desired.

Cleaning apparatus of the present invention also may have a bottom surface that normally is angled to, rather than parallel to, to-be-cleaned surfaces of a pool or spa. In side view from nominal front to nominal rear of the cleaner, the bottom surface may slope away from the to-be-cleaned surface. Consequently, an axle for rear motive elements may be further from the to-be-cleaned surface than any axle for front motive elements. By driving these larger-diameter rear motive elements as well as the front motive elements, the cleaner is less likely to become stuck on obstacles protruding upward from the to-be-cleaned surface.

Although the rear motive elements typically (but not necessarily) will be wheels, the inventive cleaner also may lack both front wheels and any side tracks. Instead, the front motive element preferably is a rotating scrub brush (or "scrubber"). Because the scrubber may too be driven, it can function both to scrub the to-be-cleaned surface and to move the cleaner within the vessel. Furthermore, the scrubber advantageously may be driven at a speed greater than that of the rear motive elements, with one preferred drive speed ratio being approximately 1.3:1.

Additional features of these novel cleaners include positioning the scrubber inside the water inlet and incorporating sensors designed to determine whether a cleaner is, or is not, submerged. Effectively causing the scrubber to form a wall or boundary of the water inlet maximizes the bottom surface which may be angled without sacrificing suction power available for debris pick-up. It also allows the scrubber itself to facilitate debris intake, as the scrubber not only agitates debris into suspension, but also helps accelerate and "paddle" the debris mechanically into the inlet. Including water sensors and linking them to motor function prevents the cleaners from operating when out of water. A presently-preferred water sensor comprises two metal posts; when the cleaner is in water, conductivity will be sufficiently high so as to close a circuit including the metal posts, establishing that motor function may begin.

At least one thrust jet of the present cleaner may exhaust water therefrom. Unlike the outlet of the Hui cleaner, that of the present invention does not cause water to exhaust perpendicular to the to-be-cleaned surface. Instead, the thrust jet exhausts water at an acute angle to both (1) the to-be cleaned surface and (2) the sloped bottom surface of the cleaner. In one embodiment of the invention, the thrust jet may exhaust water at an angle of approximately sixty degrees (~60°) to the to-be-cleaned surface so as to provide substantial down force to counteract the positive buoyancy of the cleaner while also supplying some forward motive force. Assuming a nominal slope of twenty degrees (20°) for the bottom surface yields an angle of approximately forty (~40°) between the thrust output direction and the bottom surface.

Because the water inlet of the cleaner may be positioned immediately behind (and adjacent) its front motive element, the cleaner is likely to ingest air, particularly when it is scrubbing the waterline of the vessel and thus not fully submerged. Air ingestion is an especial problem for many existing pool cleaners, as the ingested air can become trapped within the cleaners and cause them to float, a condition precluding further cleaning and possibly causing their pump motors to run dry. Unlike existing cleaners, however, those of the present invention may include domed debris collection chambers configured to facilitate handling of ingested air. Although the ingested air can also make a cleaner of the present invention float, the cleaner may be weighted and balanced such that it immediately points the nose (the portion opposite the thrust jet) down, thereby positioning the thrust jet at the highest point of the cleaner, with the ingested air having no choice but to migrate to that point along the smooth domed interior.

The thrust jet then may eject the bulk of the ingested air, aided by a small suction hole through the wall of the thrust tube, sitting at an angle from the highest point of the dome into the thrust tube behind the propeller. The Venturi principle may be employed to suck out remaining air. The smooth domed nature of the debris-collection chamber additionally prevents air pockets from accumulating within a cleaner.

Mechanical actions associated with drive and thrust motors and start switches of the cleaners may avoid penetrating the motor blocks of the cleaners by utilizing magnets. Doing so allows operation of the thrust motor even when dry. In at least some versions of the invention, a drive motor may use an array of four magnets on a disk, interfacing linearly with another disk of four magnets on the other side of a sealed wall. In these versions the thrust motor may have four rectangular magnets which interact radially (rather than linearly) with magnets on the other side of a thin-walled tube. This approach eliminates an axial load on the shafts of both the motor and the propeller and provides an energy-efficient system as compared to a frictional lip seal solution.

The magnet drives also may function as clutches when motive elements or propellers are stopped or jammed (as by debris, for example). Whereas a direct lip seal drive normally causes a current spike when such jamming occurs, which may harm batteries or electronics, the magnet drive will not. Finally, the start switch of a cleaner may be activated internally by a magnet moving over, e.g., a reed switch on the other side of a sealed wall of the motor housing, again preserving the integrity of the motor housing.

It thus is an optional, non-exclusive object of the present invention to provide cleaning devices for water-containing devices including spas with complex interior geometries.

It is another optional, non-exclusive object of the present invention to provide automatic cleaning devices that have positive buoyancy in water.

It is also an optional, non-exclusive object of the present invention to provide automatic cleaning devices in which down force may be generated to offset their positive buoyancy.

It is a further optional, non-exclusive object of the present invention to provide automatic cleaning devices having sloped bottom surfaces which are not parallel to to-be-cleaned surfaces.

It is, moreover, an optional, non-exclusive object of the present invention to provide automatic cleaning devices in which a (or the) front motive element may be a rotating scrub brush.

It is an additional optional, non-exclusive object of the present invention to provide automatic cleaning devices in which a front motive element is driven at a different speed than are rear motive elements.

It is yet another optional, non-exclusive object of the present invention to provide automatic cleaning devices in which rotating scrub brushes form walls or boundaries of the water inlets and facilitate lifting of debris into the cleaning devices.

It is an added optional, non-exclusive object of the present invention to provide automatic cleaning devices in which water is exhausted from the devices at acute angles to both the to-be-cleaned surfaces and the sloped bottom surfaces of the cleaners.

It is also an optional, non-exclusive object of the present invention to provide automatic cleaning devices designed to facilitate removal of air ingested into the cleaners.

It is a further optional, non-exclusive object of the present invention to provide automatic cleaning devices in which magnets may be employed as part of drive and thrust operations of the cleaners.

Other objects, features, and advantages of the present invention will be apparent to persons skilled in the relevant art with reference to the remaining text and the drawings of this application.

DETAILED DESCRIPTION

Illustrated in FIGS. 1-5 is a version of cleaner 10. Cleaner 10 preferably is an automatic device, configured to be submerged and travel autonomously within a spa or other water-containing vessel without manual assistance or external cords or cables. Although cleaner 10 may be sized consistent with the vessel in which it is to operate, preferred dimensions of cleaner 10 may be approximately 216 mm wide, 195 mm long (front to rear), and 182 mm high. If so sized, cleaner 10 may be especially useful in cleaning recreational and therapeutic spas, which conventionally are smaller than most swimming pools.

Figure 1:
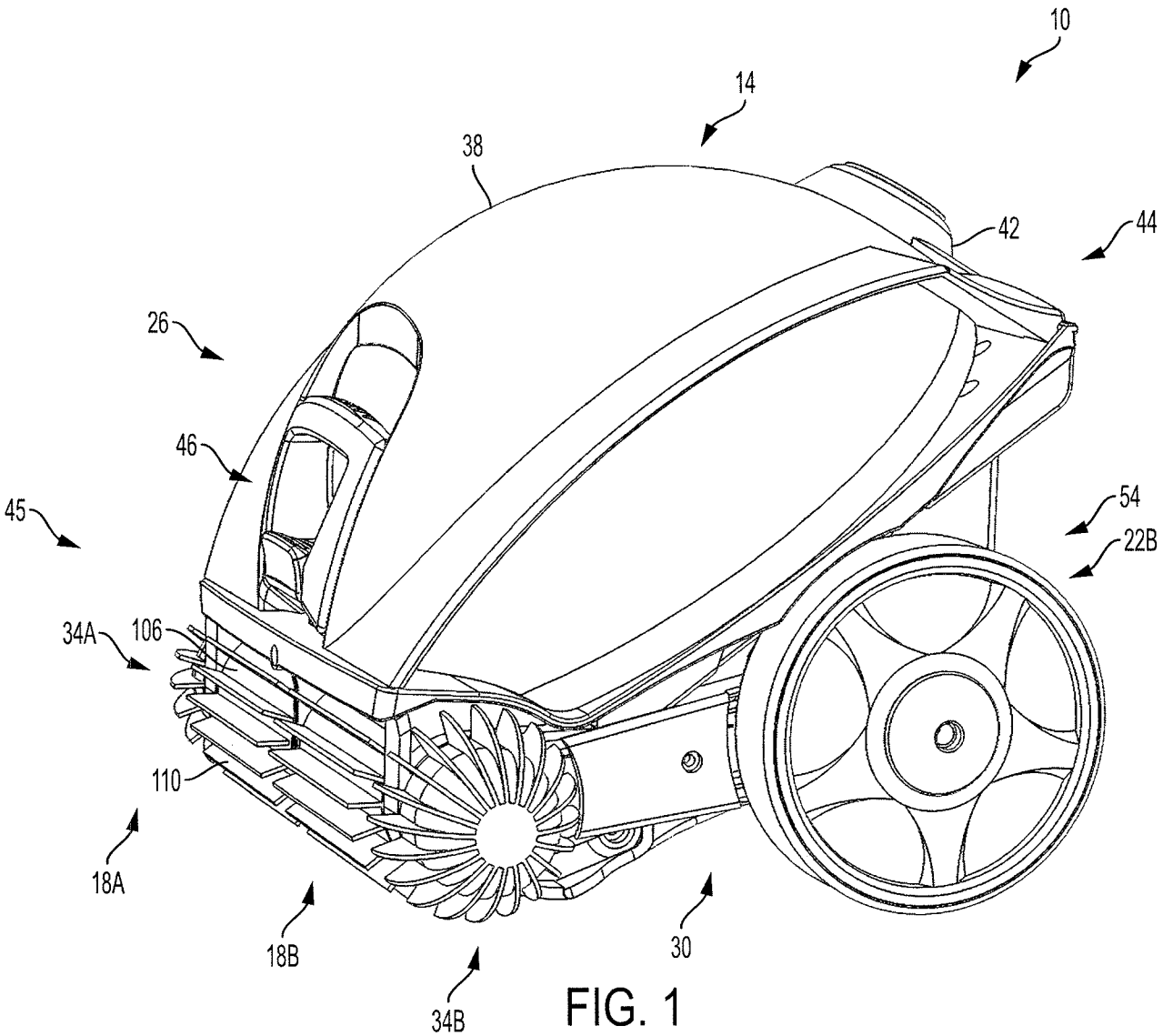
FIG. 1 is a perspective view of an automatic cleaner consistent with the present invention showing, principally, a nominal front and side of the cleaner.
Figure 2:
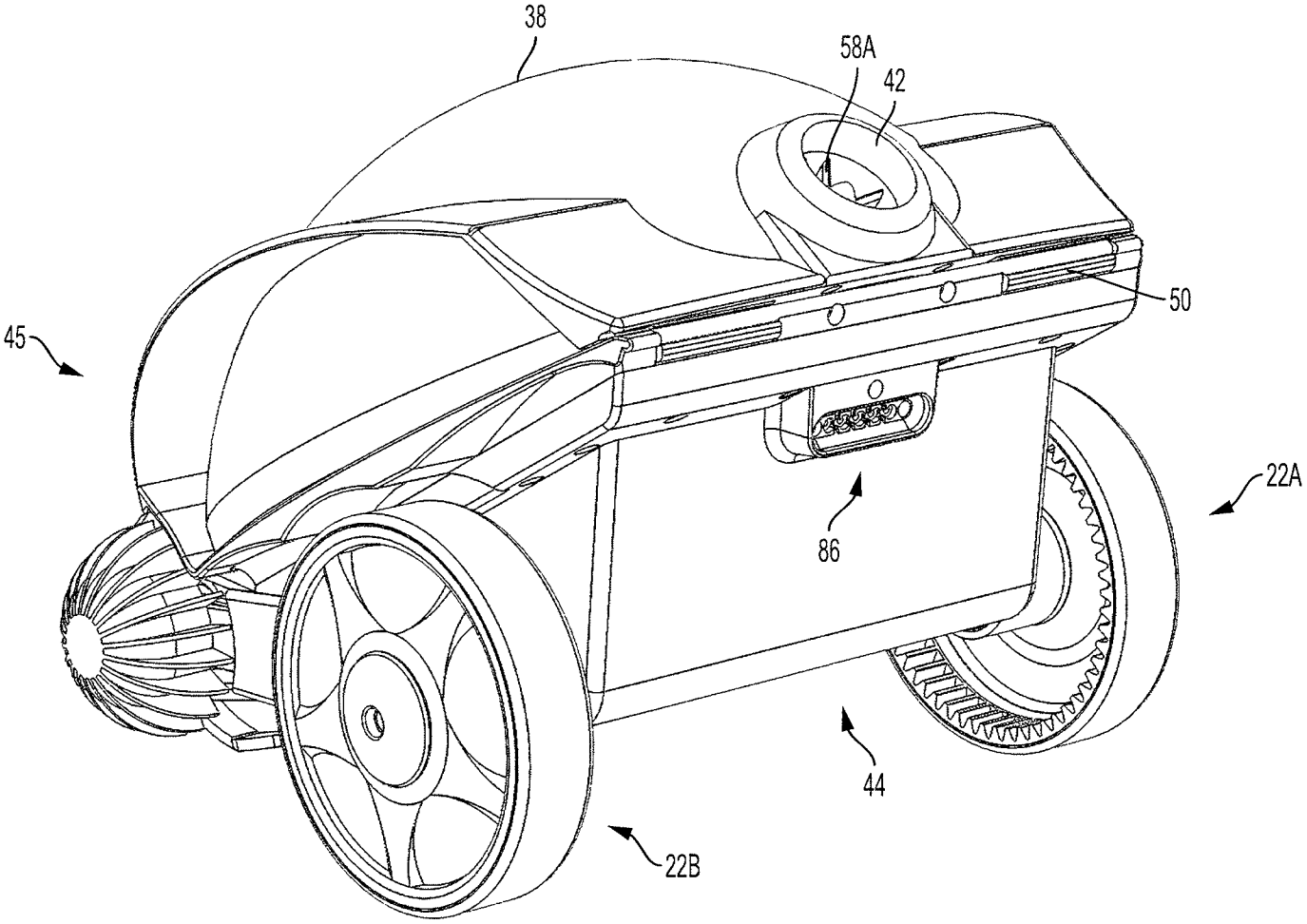
FIG. 2 is another perspective view of the cleaner of FIG. 1 showing, principally, a nominal rear and side of the cleaner.

Cleaner 10 also preferably (but not necessarily) is buoyant in water of a pool or spa. As shown in FIGS. 1-5, cleaner 10 may include body 14, one or more (nominally) front motive elements 18, and one or more (nominally) rear motive elements 22. FIGS. 1 and 4 detail the presence of two front motive elements 18 in the form of first and second scrubbers 18A and 18B, respectively. FIGS. 2 and 5 detail the presence of two rear motive elements 22A and 22B, again respectively.

Rear motive elements 22A and 22B preferably are wheels, with element 22A being positioned at or to side 26 of body 14 and element 22B being positioned at or to side 30 of body 14. Elements 22A and 22B may be connected to one or more drive motors and driven either separately or together. As best illustrated in FIGS. 2 and 4, elements 22A and 22B may be aligned such that they rotate about a common axis. The elements 22A and 22B further may, but typically will not, share a common axle.

Whereas rear motive elements 22 preferably are wheels, front motive elements 18 preferably are not. Instead, front motive elements 18 beneficially may be scrubbers. Nevertheless, scrubbers 18A and 18B may be connected to one or more drive motors 31 (see FIG. 10) and driven either separately or together. If two or more elements 18 are present, they advantageously may be aligned such that they rotate about a common axis and may, but typically will not, share a common axle.

Also depicted in FIG. 1 are front caps 34A and 34B. Front cap 34A is shown as being positioned adjacent scrubber 18A at or to side 26 of body 14, and front cap 34B is positioned adjacent scrubber 18B at or to side 30 of the body 14. Body 14 additionally may have a generally dome-shaped lid 38, as illustrated in FIG. 1, which itself may include an exhaust port 42. Persons skilled in the art will recognize that port 42 may be located elsewhere in connection with cleaner 10, although its presently-preferred placement is a laterally-central area of the cleaner 10 toward or at the nominal rear portion 44 of body 14 (see FIG. 2).

Figure 6:
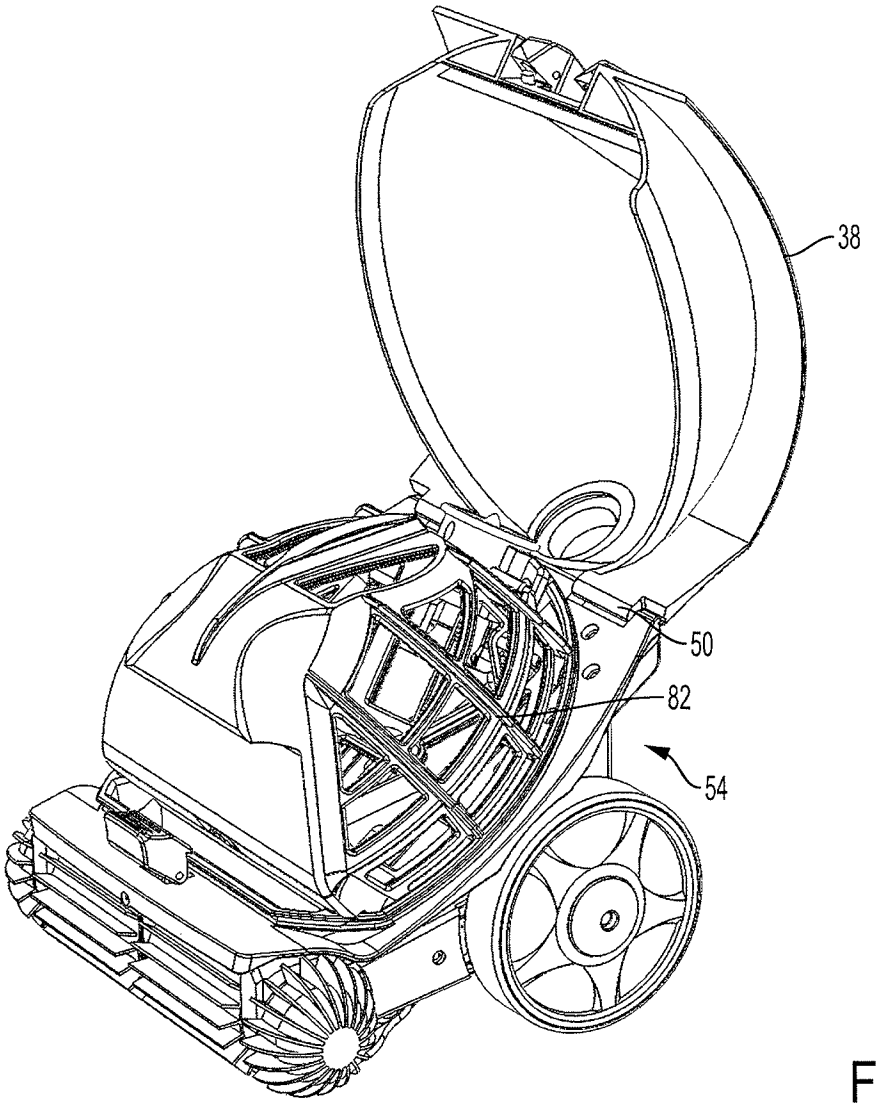
FIG. 6 is a perspective view of the cleaner of FIG. 1 with a lid of the cleaner opened to expose certain components within the body of the cleaner.

FIG. 1 additionally illustrates a clip and handle assembly 46 beneficially located toward or at the nominal front portion 45 of body 14. Assembly 46, together with hinges 50 (see FIG. 6), facilitates opening and closing of lid 38 relative to nominally lower section 54 of body 14, with its clip portion either locking lid 38 in place (as in FIG. 1) or allowing it to open (as in FIG. 6). If desired assembly 46 also may be constructed to include a handle or similar device allowing a person to grasp lid 38 and either move it relative to lower section 54 or, if lid 38 is locked in place, to move the entirety of cleaner 10 from place to place.

Figure 7:
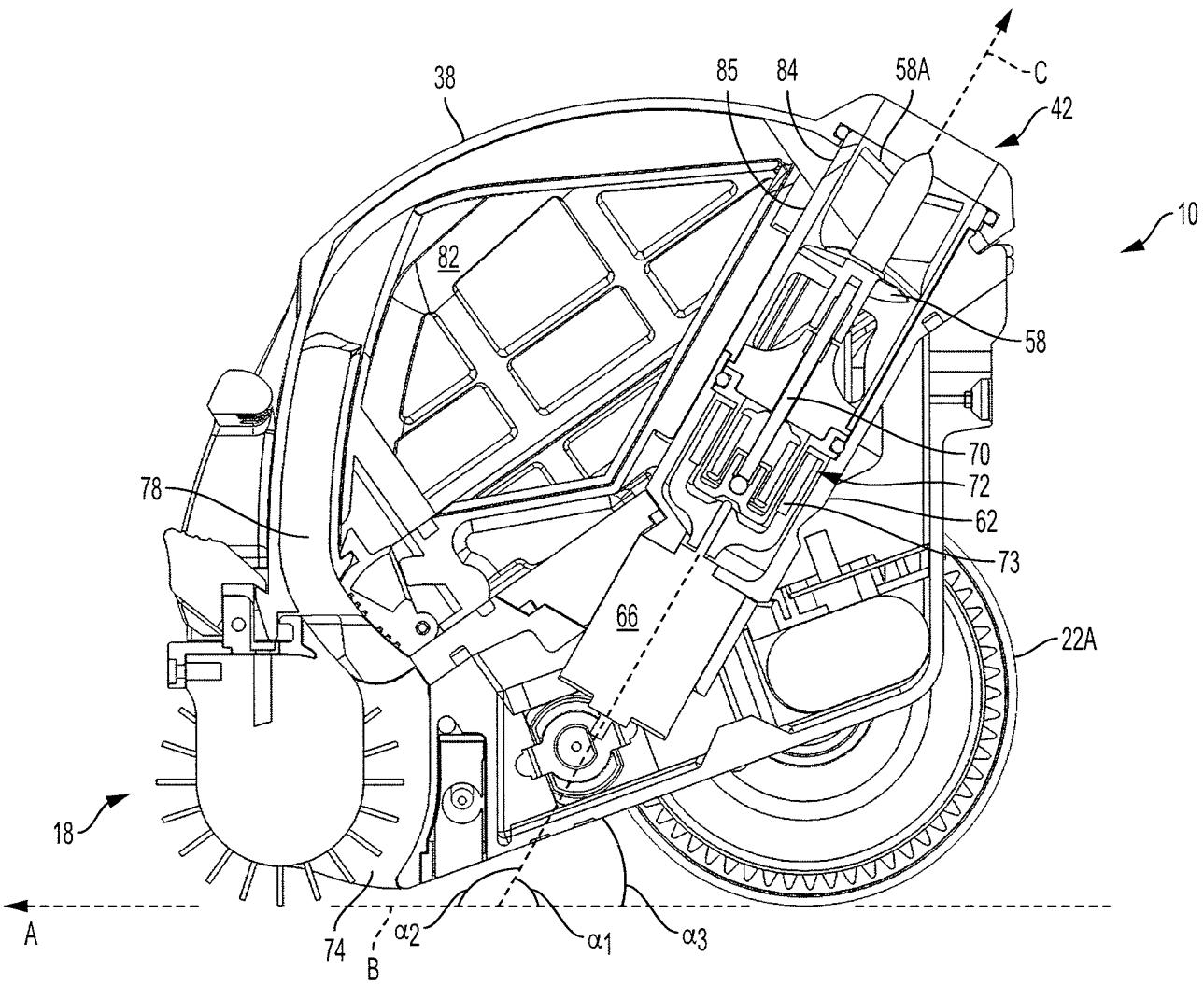
FIG. 7 is a sectioned elevational view of the cleaner of FIG. 1.

Thrust may be provided, at least in part, by jetting water outward from port 42. FIG. 7 shows propeller 58 placed within body 14 together with thrust-straightening vanes 58A at or near port 42; when operating, the propeller 58 may push water from within the body 14 to, and out of, port 42, hence creating the thrust jet discussed earlier in this application. Propeller 58 and vanes 58A may be part of thrust assembly 62 (see FIG. 7), which also may include motor 66 and shaft 70 connecting the propeller 58 to the motor 66 as well as thrust tube 85. As is conventional, motor 66 operates to rotate shaft 70, in turn rotating propeller 58.

Thrust assembly 62 additionally may include magnet assembly 72 comprising one or more magnets 73. Employing magnets to effect some mechanical actions may enhance the seal integrity of assembly 62 and be beneficial by allowing operation of motor 66 even when dry. By contrast, normal lip seals can overheat and be damaged when run dry.

In the version of magnet assembly 72 illustrated in FIG. 7, four rectangular magnets 73 exists and interact with radially (rather than linearly) with magnet on the other side of a thin-walled tube within body 14. This configuration eliminates axial loads on shaft 70 and is particularly energy-efficient as compared with conventional lip-seal approaches. Magnets 73 may differ in number, shape, and placement, however, as is necessary or desired. Finally, magnet assembly 72 may also function as a clutch should, for example, propeller 58 be jammed or have its rotation stopped by debris. Again, by contrast, such jamming would be detrimental to direct lip-seal drives, normally causing current spikes capable of harming batteries and electronics.

FIG. 7 depicts nominal forward direction of movement "A" of cleaner 10 along a to-be-cleaned surface "B." Thrust assembly 62 exhausts pressurized water out port 42 in direction "C," which forms an acute angle $\alpha_1$ with surface B and an obtuse angle $\alpha_2$ with vector A. (This can be readily contrasted with, for example, the cleaners of the Hui application, in which the angles corresponding to $\alpha_1$ and $\alpha_2$ would both be right angles.) A presently-preferred value for angle $\alpha_1$ is approximately sixty degrees (~60°), which continues to allow the exhausted water to provide substantial down force to cleaner 10. Persons skilled in the art will recognize that other values less than ninety degrees (<90°) may be acceptable as well.

Inlet port 74 appears in FIG. 7. Port 74 leads to inlet section 78 of filter 82 within body 14. Clear from FIG. 7 is that port 74 may be adjacent front motive elements 18, positioned immediately behind the elements 18 relative to the normal direction of travel A. Motive elements 18 hence may be considered to be within or inside port 74 or to form a wall or boundary thereof. Counterclockwise rotation of elements 18 thus serves not only to agitate debris into suspension, but also to accelerate and "paddle" the debris mechanically into inlet port 74 and inlet section 78 of the filter 82.

So positioning port 74 leads to efficient movement of debris-laden water into filter 82 within body 14. However, it also increases the likelihood of cleaner 10 ingesting air, particularly when the cleaner 10 is only partially submerged while scrubbing a wall or similar surface at the waterline of a vessel. Introducing air into a water-pumping system can be detrimental for multiple reasons, including causing a pump motor to run dry and the associated cleaner to float away from the surface to be cleaned. To reduce these detrimental aspects of air ingestion, cleaner 10 may be weighted and balanced such it immediately points front portion 45 downward, thereby positioning port 42 (and therefore the exhaust from body 14) at the highest point of the cleaner 10. Because lid 38 is shaped as a dome with a generally smooth interior surface, ingested air hence must migrate within lid 38 to that highest point, where it too can be expelled.

Indeed, because motor 66 may continue operating even when air is ingested, it may eject most of the ingested air through port 42. This ejection may be aided by opening 84, a small suction hole in a wall of thrust tube 85 angled from the highest point of lid 38. Utilizing the Venturi principle, fluid flowing out port 42 may cause ingested air to be evacuated from body 14 through opening 84 and out port 42.

Figure 8:
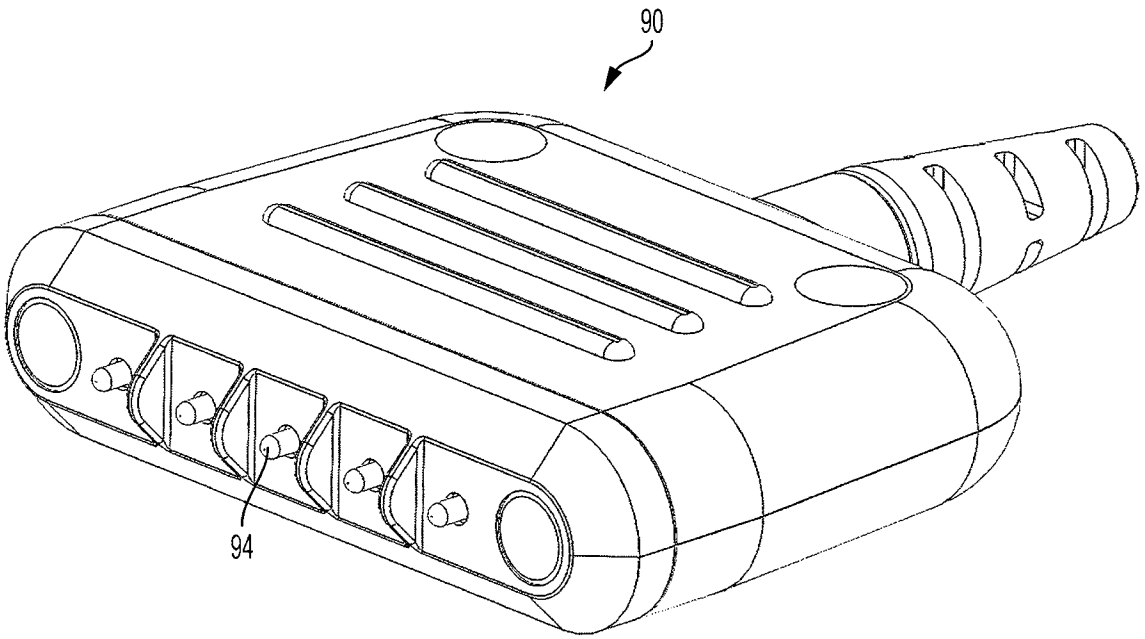
FIG. 8 is a perspective view of a male portion of a multi-pin contact charger for batteries of the cleaner of FIG. 1.

Rear portion 44 of body 14 may include interface 86 useful to charge one or more batteries within the body 14 powering the various motors. In at least one version of body 14, interface 86 may be a female portion of a multi-pin contact charger. FIG. 8 illustrates a corresponding male portion 90 of the charger. Portion 90 may self-latch to interface 86 using magnets. In the five-pin embodiment of portion 90 depicted in FIG. 8, which may be reversible left to right, connection of center pin 94 to a corresponding center opening of interface 86 may signal that the charger is operational. Once certain pin 94 is removed, power to the other four pins is withdrawn so as to avoid power leaking into the water of the vessel.

At present, lithium iron (LFP) batteries are preferred for use as part of cleaner 10. Their charge statuses may be monitored during operation of cleaner 10 and, if desired, energy to the various motors may be increased as the batteries are exhausted so as to maintain approximately constant performance of cleaner 10 during a cleaning cycle. One or more light emitting diodes or other devices may indicate performance statuses of the cleaner 10.

Figure 3:
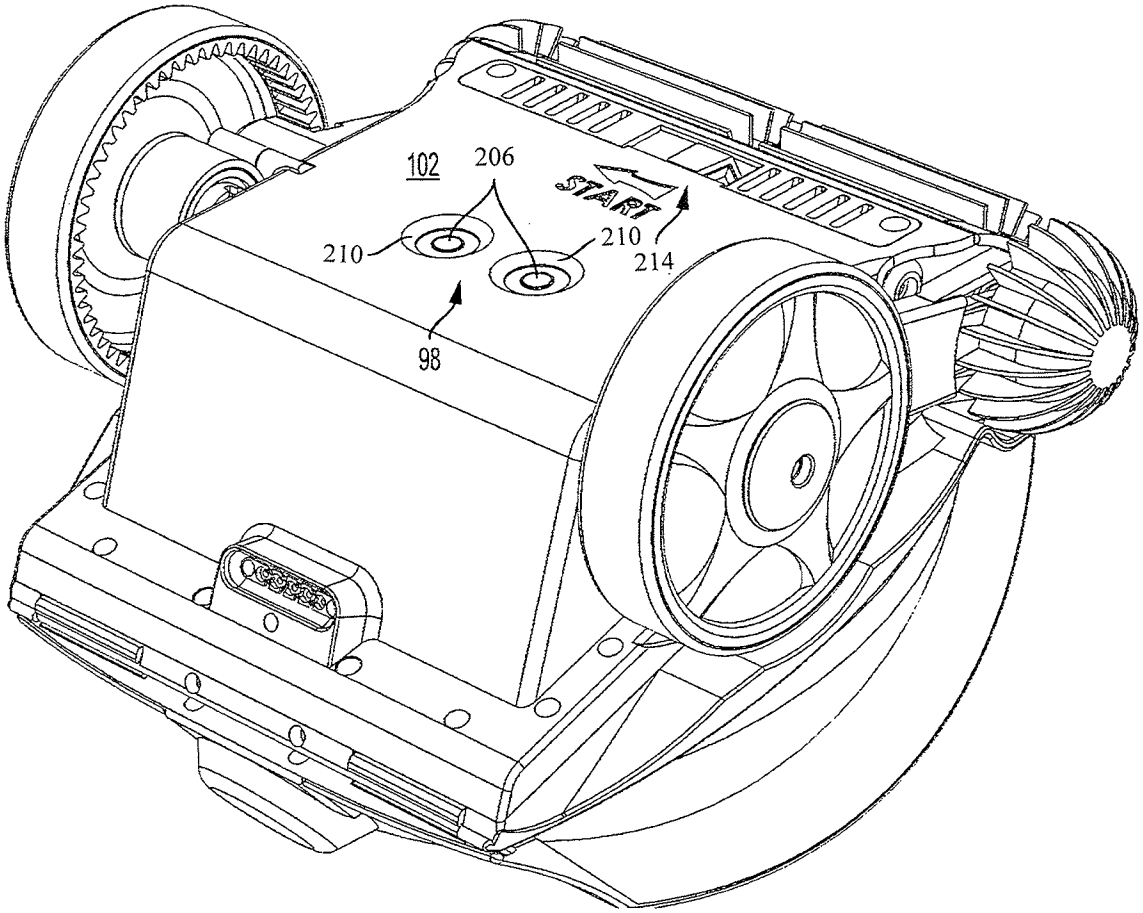
FIG. 3 is another perspective view of the cleaner of FIG. 1 showing, principally, a bottom, side, and nominal rear of the cleaner.
Figure 4:
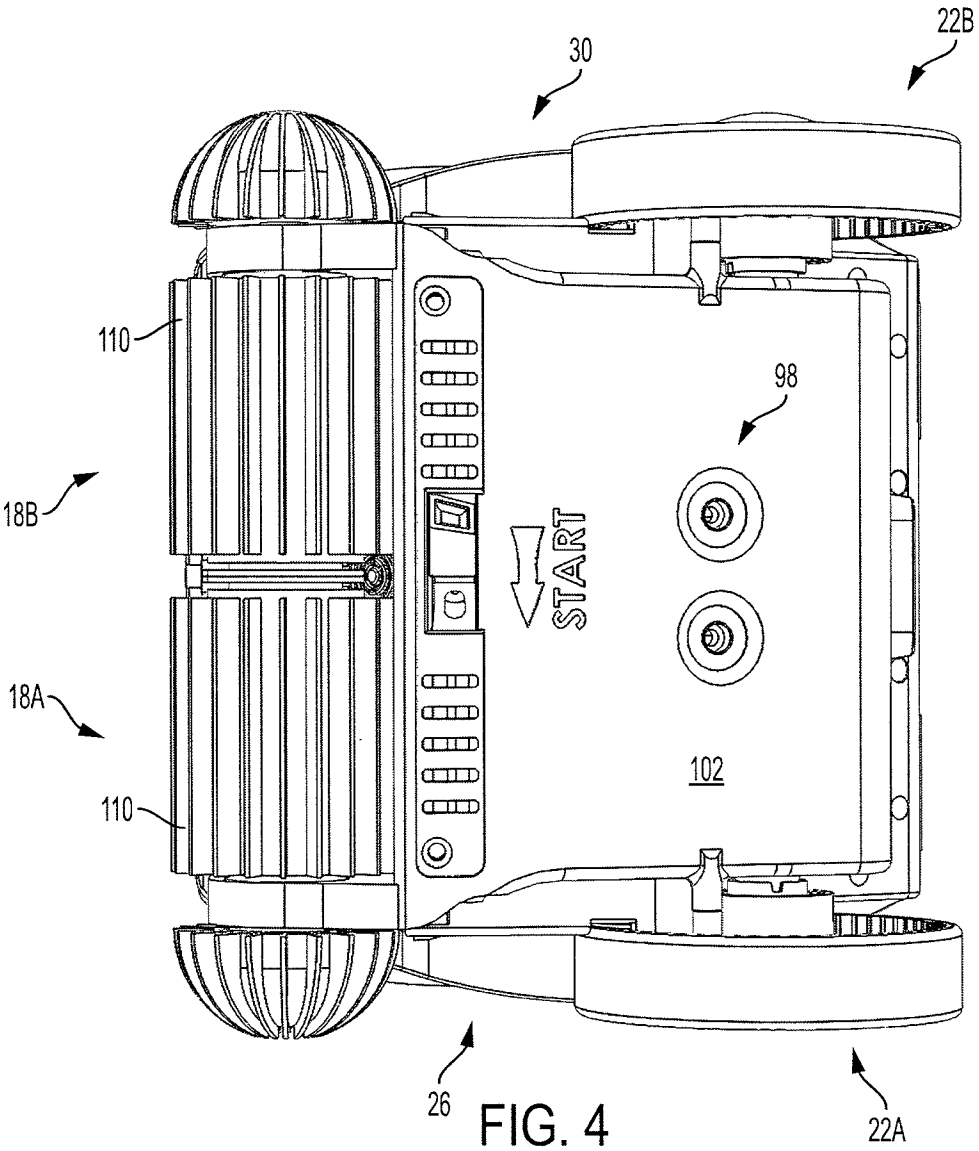
FIG. 4 is a bottom plan view of the cleaner of FIG. 1.
Figure 5:
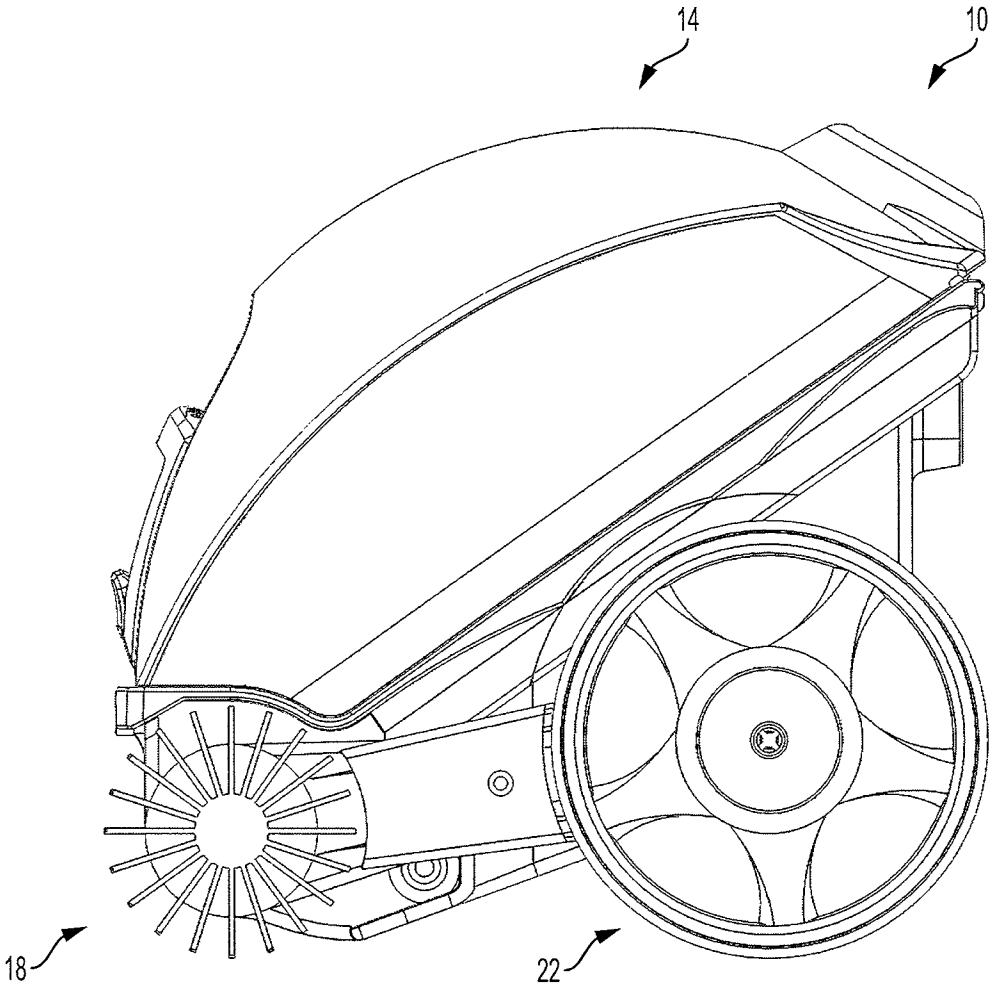
FIG. 5 is a side elevational view of the cleaner of FIG. 1.

FIGS. 3-4 depict sensor 98 present on bottom surface 102 of body 14. Sensor 98 may be designed to ascertain whether body 14 is immersed in water, sensing conductivity changes between its two metallic posts 206 due to the presence, or absence, of water. A well 210 may circumscribe each post 206 and contain wax so as to enhance reliability of the sensing. Preferably, when sensor 98 does not detect the presence of water, power to the various motors of cleaner 10 will be withdrawn immediately. Sensor 98 also, if desired, may function together with a magnetic start switch 214; if the start switch 214 is "on" and sensor 98 detects that cleaner 10 is in water, power will be provided to the motors of the cleaner 10.

Among significant features of cleaner 10 is that bottom surface 102 is sloped relative to a to-be-cleaned surface such as surface B of FIG. 7. As illustrated in that figure, bottom surface 102 thus may form an angle $\alpha_3$ with surface B rather than be parallel thereto (as in the cleaners of the Hui application, for example). One presently-preferred value for angle $\alpha_3$ is approximately twenty degrees (~20°), although other values may be satisfactory as well.

Bottom surface 102, furthermore, may be closest to surface B at front portion 45 (adjacent inlet port 74) and farther from surface B at rear portion 44. The increased distance between bottom surface 102 and surface B toward rear portion 44 materially minimizes, if not wholly prevents, high centering of cleaner 10 otherwise possibly caused by a cleaner encountering an obstacle protruding from surface B and disengaging all driven motive elements from the surface B.

Scrubbers 18A-B preferably are driven at a higher speed than are rear wheels 22A-B, with an exemplary (but not exclusive) speed ratio being approximately 1.3:1. Driving scrubbers 18A-B at a higher speed allows them to scrub a surface (such as surface B) as they rotate while concurrently helping cleaner 10 travel along the surface. This approach may be contrasted with that of conventional cleaners, which typically drive their motive elements at the same rotational speed.

Collectively, scrubbers 18A-B may extend more or less completely across the width of body 14. The angling of bottom surface 102 ($\alpha_3$) and the exhausted water ($\alpha_2$) effectively move the high-centering point of cleaner 10 near the scrubbers 18A-B. However, because scrubbers 18A-B are motive elements, they may drive cleaner 10 (effectively levering front portion 45) over obstacles. If desired to facilitate turning of cleaner 10, scrubber 18A may always be driven in the same direction (clockwise or counterclockwise) as its corresponding wheel 22A, and scrubber 18B may be driven in the same direction as wheel 22B, but scrubber 18A/wheel 22A need not always be driven in the same direction as scrubber 18B/wheel 22B.

Figure 11:
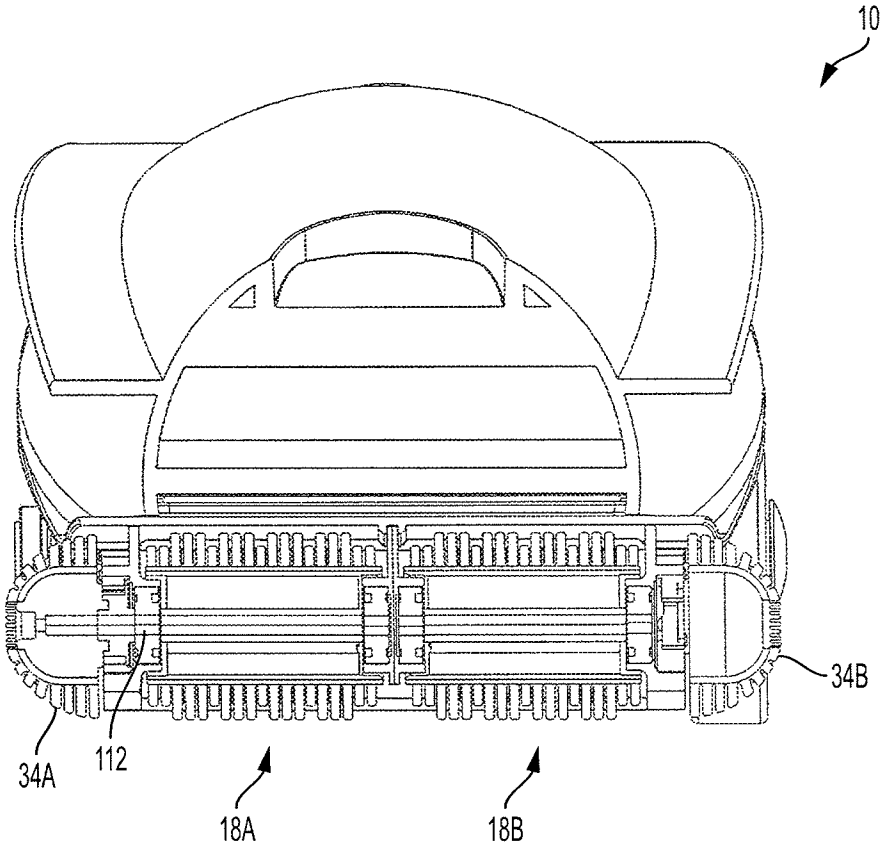
FIG. 11 is another sectioned view of the cleaner of FIG. 1.

Each scrubber 18A or 18B may comprise core 106 and extensions 110. Core 106 typically will be cylindrically shaped with a central longitudinal bore or annulus for receiving an axle 112. The axle 112, in turn, can be directly or indirectly connected to a motor of cleaner 10 so as to rotate it. Extensions 110 may, if desired, be in the form of blades protruding from, and spaced along, the circumference of core 106. In general, at least extensions 110 have substantial flexibility. Caps 34A-B may function to protect the drive mechanism of scrubbers 18A-B from contact with certain features of spas or pools and to prevent high-centering of that mechanism. Because caps 34A-B may protrude beyond the nominal width of body 14, they additionally may facilitate brushing and cleaning of, e.g., corners of pools and spas. FIG. 11, further, shows that axle 112 may extend beyond scrubbers 18A and 18B for use in rotating caps 34A-B as well.

Figure 9:
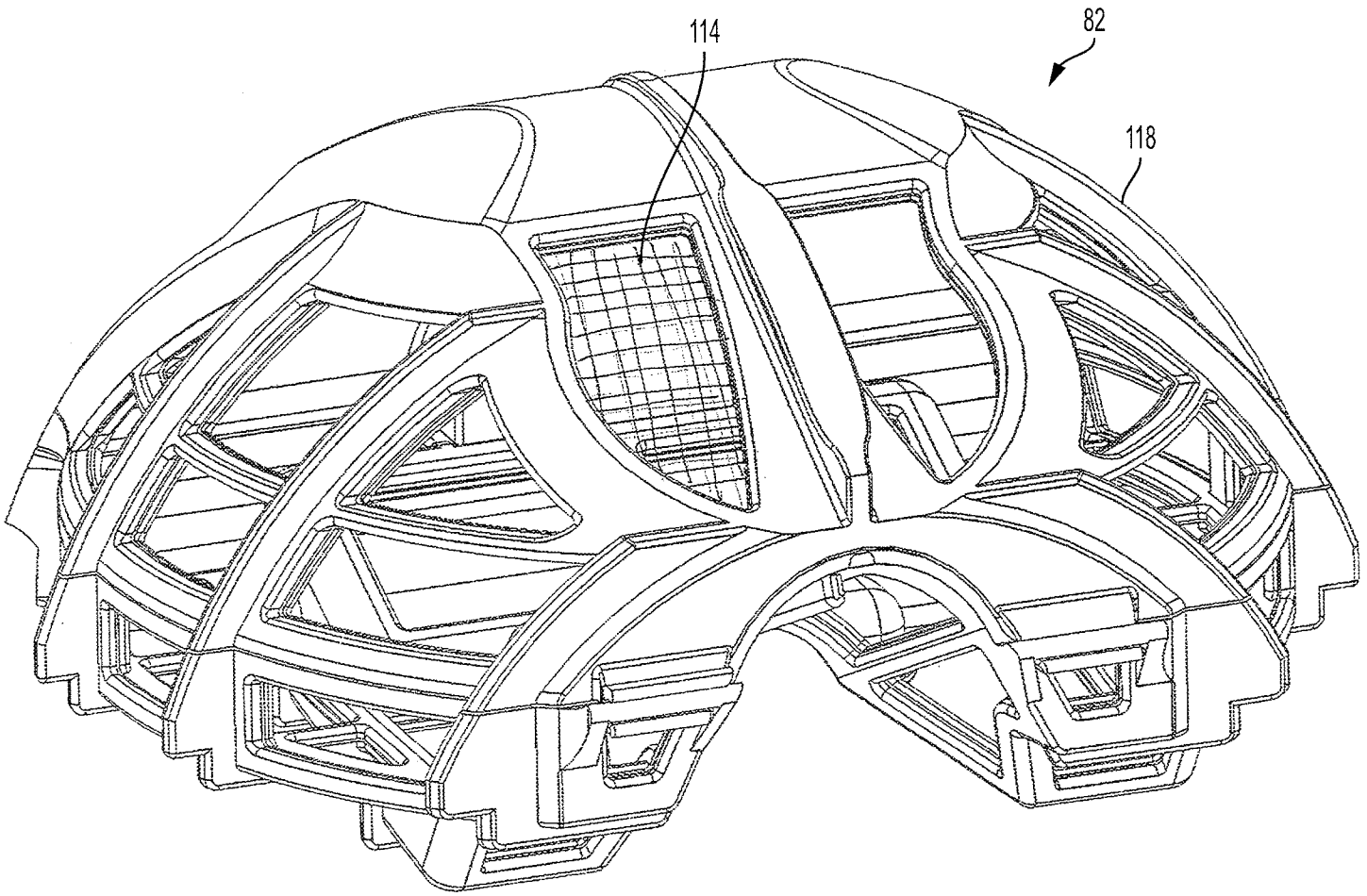
FIG. 9 is a perspective view of a filter for placement within the body of the cleaner.

An exemplary filter 82 is illustrated in FIG. 9. A preferred filter 82 fits within body 14 between bottom surface 102 and lid 38 in a manner so that debris-laden water entering inlet port 74 must encounter it before exiting via exhaust port 42. As shown in FIG. 9, filter 82 may comprise mesh 114 supported by frame 118. Most particulate debris suspended in water entering port 74 will be stopped (blocked) by mesh 114, mechanically cleaning the water as it passes through the filter 82. Filter 82 advantageously is removable from body 14 for emptying debris and cleaning and, if desired, may have frame 118 made of two parts, one hinged or otherwise movably connected to the other so as to allow the frame 118 to open and expose debris therein.

Figure 10:
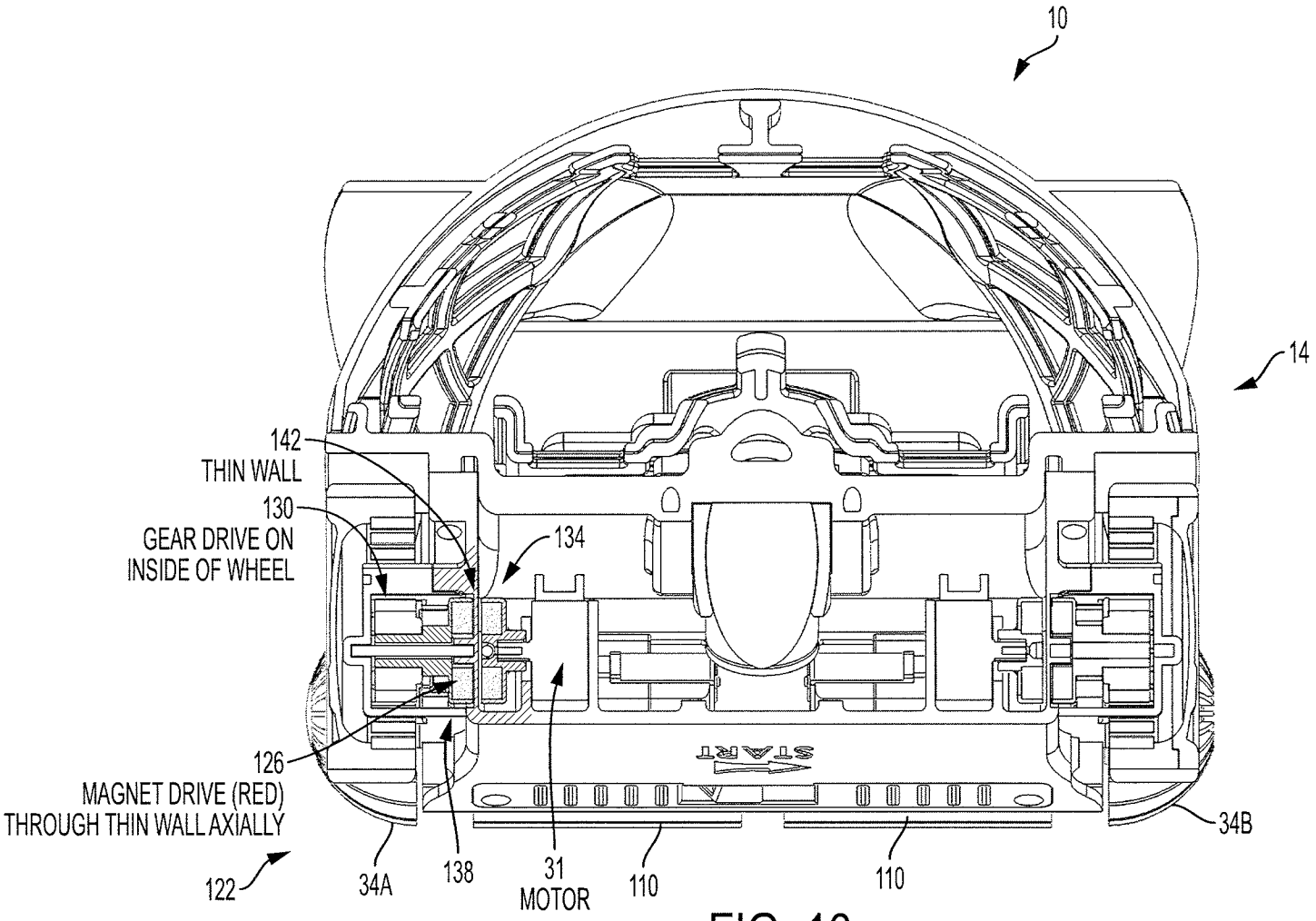
FIG. 10 is a sectioned view of the cleaner of FIG. 1 showing, principally, components of a magnetic drive assembly of the cleaner.

Depicted in FIG. 10 are components of a drive motor assembly 122. Two such assemblies 122 preferably are present in cleaner 10, although more or fewer may be included as desired. As shown in FIG. 10, an assembly 122 may include motor 31, magnet drive 126, and gear drive 130. Magnet drive 126 may include a first array of magnets 134 on a disc, with the magnets 134 interfacing linearly with another disc of magnets 138 opposite a sealed wall 142. As with magnet assembly 72, magnet drive 126 may avoid use of lip seals, as no shaft need penetrate wall 142, and function as a clutch should motive elements 18, for example, become jammed.

The foregoing is provided for purposes of illustrating, explaining, and describing embodiments of the present invention. Modifications and adaptations to these embodiments will be apparent to those skilled in the art and may be made without departing from the scope or spirit of the invention. As but one example, cleaner 10 may be adapted to receive control signals from a remote source (e.g. a wireless transmitter, as typically exists in a smartphone) capable of controlling aspects of operation of the cleaner 10. Such control signals could, for example, change speed or rotation direction of any or all of motive elements 18 or 22 (or disable their drives) or inhibit or change operational characteristics of thrust assembly 62. Cleaner 10 may also be adapted to transmit information about its operation or the water within the vessel to a location remote therefrom. As yet another example, cleaner 10 may include an on-board processor and memory for creation and storage of control information or data (or both), whether or not such information or data is transmitted to or received from a remote source of location.

What is claimed is:

1. An automatic cleaner for a water-containing vessel, comprising:

a. a body comprising an inlet, an outlet, a rear, and a bottom surface having a generally planar portion extending from the inlet to the rear;

b. means, comprising a front motive element and a rear motive element, for moving the body along a surface of the vessel; and c. means for exhausting water from the body through the outlet in a first direction; and in which (i) each of the generally planar portion of the bottom surface and the first direction forms an acute angle with the surface of the vessel when the body is moving along the surface of the vessel and (ii) the bottom surface slopes upward so as to be closer to the surface of the vessel at the front motive element than at the rear motive element.

2. An automatic cleaner according to claim 1 in which the generally planar portion of the bottom surface is planar.

3. An automatic cleaner according to claim 1 in which the acute angle formed between the generally planar portion of the bottom surface and the surface of the vessel differs from the acute angle formed between the first direction and the surface of the vessel.

4. An automatic cleaner according to claim 3 in which the acute angle formed between the generally planar portion of the bottom surface and the surface of the vessel is approximately 20° and the acute angle formed between the first direction and the surface of the vessel is approximately 60°.

5. An automatic cleaner for a water-containing vessel, comprising:

a. a body comprising an inlet, an outlet, and a bottom surface having a generally planar portion;

b. means, comprising a front motive element and a rear motive element, for moving the body along a surface of the vessel; and c. means for exhausting water from the body through the outlet in a first direction; and in which (i) each of the generally planar portion of the bottom surface and the first direction forms an acute angle with the surface of the vessel when the body is moving along the surface of the vessel and (ii) the bottom surface slopes upward so as to be closer to the surface of the vessel at the front motive element than at the rear motive element.

6. An automatic cleaner for a water-containing vessel, comprising:

a. a body comprising an inlet, an outlet, a front portion, a rear, and a bottom surface having a generally planar portion extending from the inlet to the rear;

b. means, comprising at least one driven front motive element and at least one driven rear motive element, for moving the body along a surface of the vessel; and c. means for exhausting water from the body through the outlet in a first direction; and in which (i) the generally planar portion of the bottom surface forms an acute angle of approximately 20° with the surface of the vessel when the body is moving along the surface of the vessel, (ii) the first direction forms an acute angle of approximately 60° with the surface of the vessel when the body is moving along the surface of the vessel, (iii) the bottom surface slopes upward so as to be closer to the surface of the vessel at the at least one driven front motive element than at the at least one driven rear motive element, (iv) the at least one driven front motive element comprises a scrubber, (v) the at least one driven rear motive element comprises a wheel, and (vi) the scrubber is driven at a higher rotation speed than the wheel.

* * * * *